US005307253A

United States Patent [19]

Jehn

[11] Patent Number: 5,307,253

[45] Date of Patent: Apr. 26, 1994

[54] STRUCTURE OF LASER POINTER

[76] Inventor: E. F. Jehn, 10F, No. 185, Yung Chi Rd., Taipei, Taiwan

[21] Appl. No.: 988,047

[22] Filed: Dec. 9, 1992

[51] Int. Cl.[5] ..... F21K 7/00; B43K 29/10

[52] U.S. Cl. ..... 362/259; 362/118; 401/195; 401/52

[58] Field of Search ..... 362/259, 118, 109, 157, 362/205; 401/195, 52; 353/42

[56] References Cited

U.S. PATENT DOCUMENTS

| | | | |
|---|---|---|---|
| 2,844,710 | 7/1958 | Zinsser | 353/42 X |
| 2,964,614 | 12/1960 | Buschle | 362/118 |
| 3,078,761 | 2/1963 | Zorn | 353/42 |
| 4,738,044 | 4/1988 | Osterhout | 362/110 X |
| 4,964,024 | 10/1990 | Tsay | 362/118 |
| 5,131,775 | 7/1992 | Chen | 362/118 X |
| 5,143,465 | 9/1992 | Hou | 362/118 X |
| 5,193,897 | 3/1993 | Halsey | 362/118 |

*Primary Examiner*—Larry Jones

*Attorney, Agent, or Firm*—Lowe, Price, LeBlanc & Becker

[57] ABSTRACT

A laser pointer is disclosed consisted of a laser module, a housing, a toggle switch, a push button ballpoint pen, a battery set, and a rotary cap, wherein the housing has chambers to hold the laser module, the battery set and the push button ballpoint pen, and a clip for hanging; the toggle switch has a press rod controlled by a button to press a leaf spring on a PC board so as to electrically connect the battery set to the laser module in causing the laser module to emit a laser beam for pointing to things.

3 Claims, 8 Drawing Sheets

STRUCTURE OF LASER POINTER

BACKGROUND OF THE INVENTION

The present invention relates to pointers and relates more particularly to a pen-like laser pointer used for pointing to things on a map, chart, blackboard, etc., by means of the laser beam generated thereby.

An ordinary pointer which is used by teachers for pointing to things on a map, blackboard, etc., is generally made of a long stick. Recently, laser diode devices have been proposed for making a pointer. An ordinary laser pointer is generally comprised of a metal casing having a laser diode connected to a trigger circuit controlled by a pres contact switch to generate a laser beam for pointing to things on a map, chart, blackboard, etc. As the press contact switch is fastened to the rear end of the casing, it may be easily triggered by error in wasting power consumption. Furthermore, the use of the metal casing greatly increases the cost of this laser pointer.

SUMMARY OF THE INVENTION

The present invention eliminates the aforesaid disadvantages of the prior art laser pointer. It is therefore an object of the present invention to provide a laser pointer which prevents the laser diode thereof from being triggered by error. It is another object of the present invention to provide a laser pointer which is orthopedically engineered for comfortable holding with the hand. It is another object of the present invention to provide a laser pointer which has a unitary press button ballpoint pen for writing.

According to the present invention, the laser pointer is consisted of a housing to hold a laser module, a battery set, and a push button ballpoint pen. The housing of the laser pointer is consisted of an upper shell and a bottom shell respectively made from a plastic material through the process of injection molding and connected to each other through a welding process by an ultrasonic welding apparatus. The laser module is controlled by a toggle switch to generate a laser beam for pointing. The toggle switch is consisted of a button, a printed circuit board, and an elongated spring strip. The button has an extension strip at one end for automatic return control, and a press rod within a bottom hole thereof pressed by the button to connect the printed circuit board. The printed circuit board has one end connected to the laser module by a leaf spring and a cable and an opposite end connected to the battery set by the elongated spring strip through a rotary cap, which is fastened to the rear end of the housing.

DETAILED DESCRIPTION OF THE PREFERRED EMBODIMENT

Figure 1:
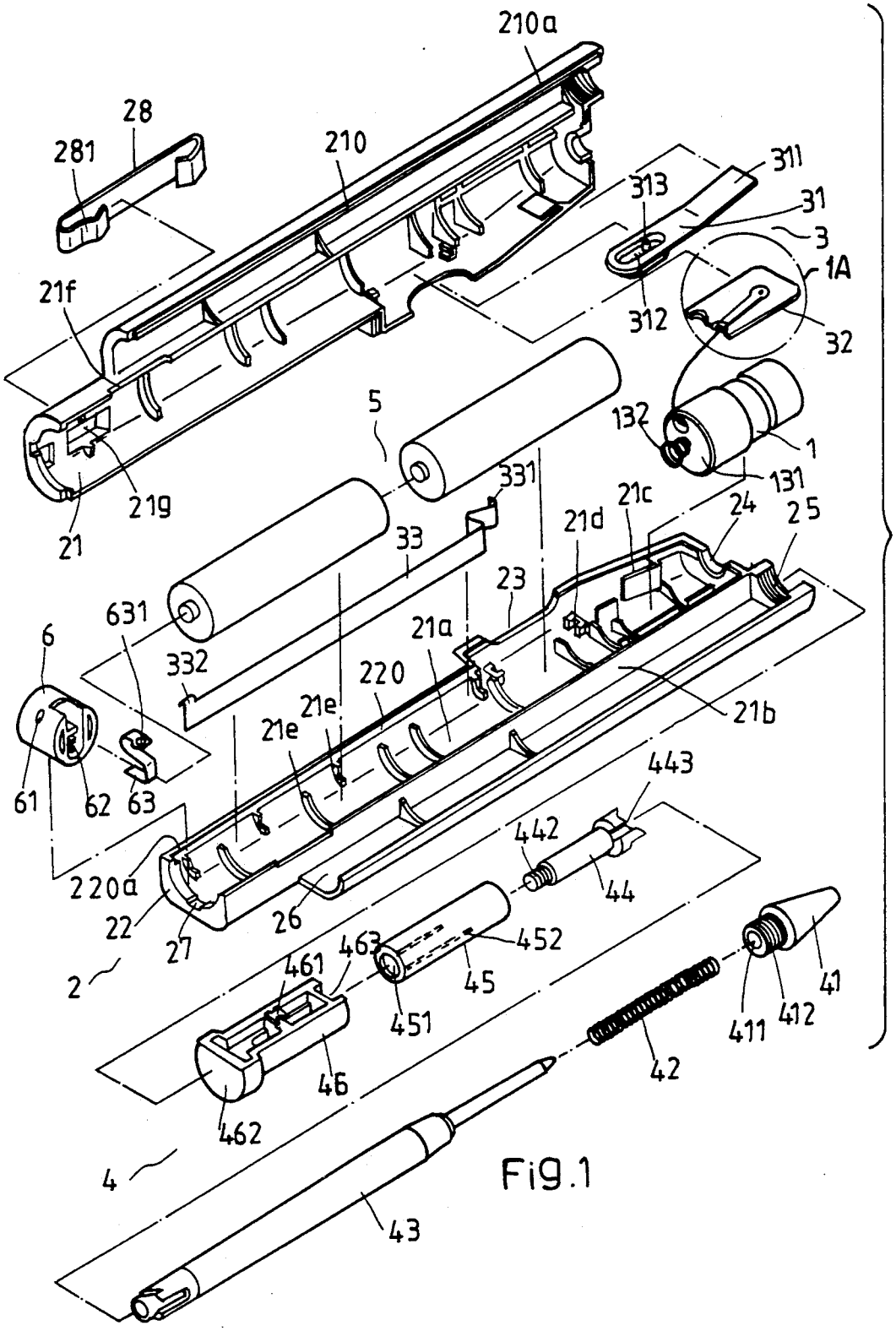
FIG. 1 is an exploded view of a laser pointer embodying the present invention.
Figure 2:
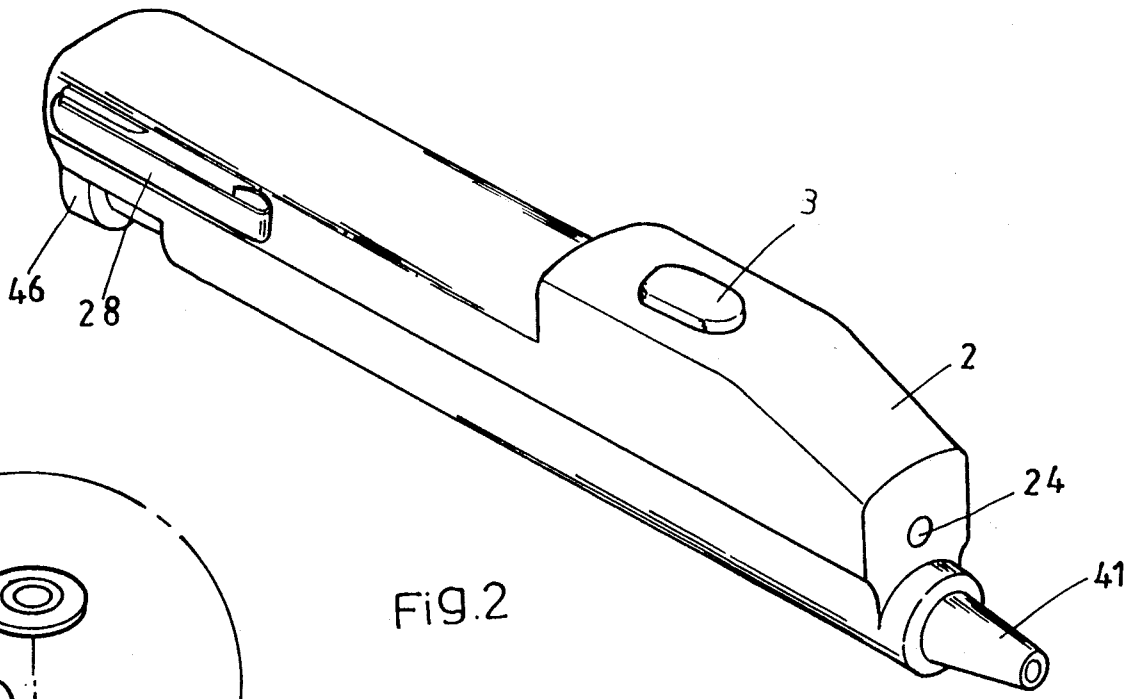
FIG. 2 is an elevational view thereof.
Figure 1A:
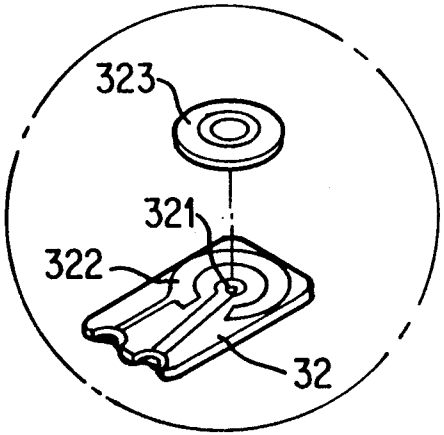
FIG. 1A illustrates the rear of the PC board, showing first and second copper loops and a leaf spring.
Figure 3:
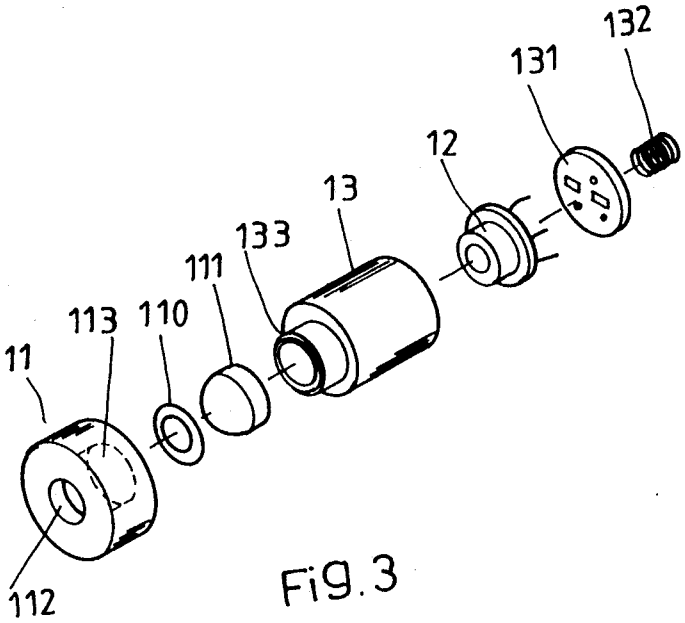
FIG. 3 is an exploded view of the laser module thereof.
Figure 4:
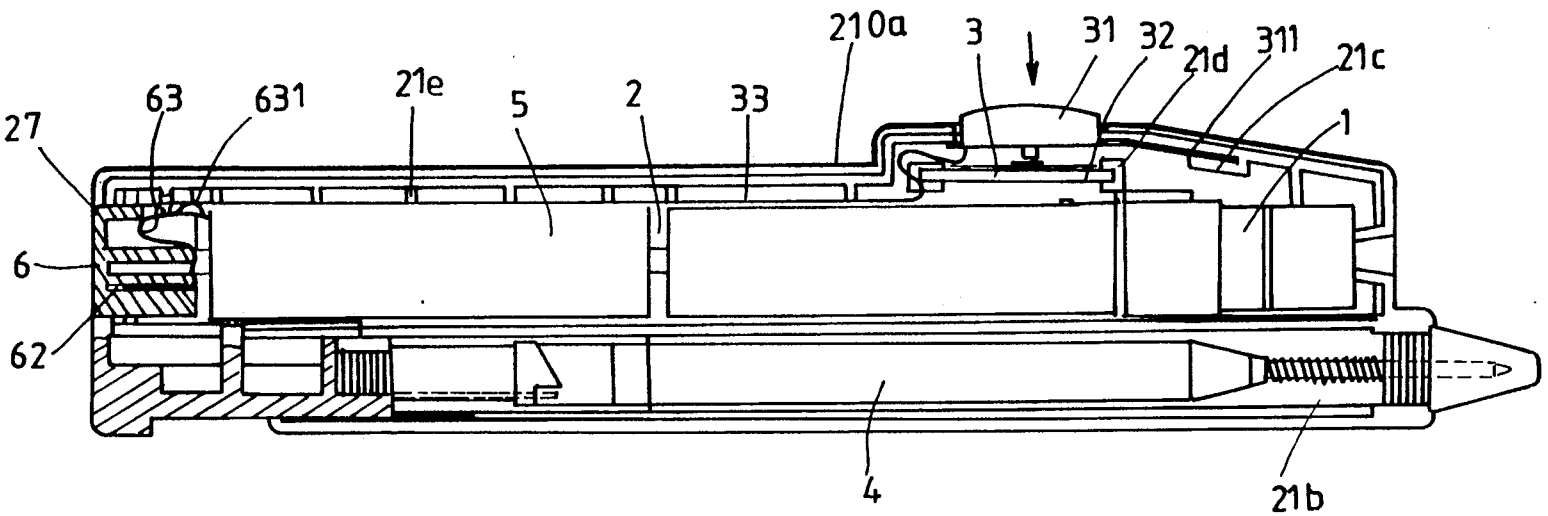
FIG. 4 is a longitudinal cross section of the laser pointer.

Referring to FIGS. 1,2,3 and 4, a laser pointer as constructed in accordance with the present invention is generally comprised of a laser module 1, a laser module 1, a housing 2, a toggle switch 3, a push button ballpoint pen 4, a battery set 5, and a rotary cap 6.

The laser module 1 is comprised of a lens assembly 11, a laser diode 12, and a laser mechanism 13. The lens assembly 11 has a plastic lens 111 fastened in a bore 113 by an O-ring 110 behind a front projecting hole 112. The laser diode 12 is inserted in the laser mechanism 13. The contact pins of the laser diode 12 are directly welded to a trigger circuit board 131 of the laser mechanism 13 at the back. The negative terminal of the trigger circuit board 131 is lead out by a spring 132, and the positive terminal thereof is connected to the printed circuit board 32 of the toggle switch 3. The laser mechanism 13 has a tubular front projection 133 fitted into the bore 113 to hold the plastic lens 111 in place. Once the lens assembly 11 and the laser mechanism 13 has been connected together, the plastic lens 111 is firmly retained between the O-ring 110 and the tubular front projection 133 of the laser mechanism 13. Therefore the focus between the front end of the tubular front projection 133 and the laser diode 12 is the focus of the laser mechanism 13, and the length of the tubular front projection 133 of the laser mechanism 13 is determined according to the focus of the plastic lens 111. Once the lens assembly 11 and the laser mechanism 13 have been tightly connected together, the focus is fixed. Because the plastic lens 111 is firmly attached to the tubular front projection 133 of the laser mechanism 13, error in concentricity is eliminated. Therefore, the laser module 1 provides good light condensing effect.

The housing 2 is consisted of two symmetrically shells, namely, the upper shell 21 and the bottom shell 22 respectively made of a plastic material through the process of injection molding. The upper shell 21 has a peripheral flange 210 inserted in a peripheral groove 220 on the bottom shell 22, and a welding strip **210*a* along the peripheral flange 210 welded to a welding strip 220*a* along the peripheral groove 220 by an ultrasonic welding apparatus. When assembled, the housing 2 defines therein a first chamber 21*a*, which receives the laser module 1 and the battery set 5, a second chamber 21*b*, which receives the push button ballpoint pen 4, a third chamber 21*c*, which receives the toggle switch 3. The housing 2 has symmetrical retaining grooves 21*d* and retaining notches 21*e* on the inside, an inside opening 21*f* between the first and second chambers 21*a*, 21*b* at one end, a toggle switch slot 23 in communication with the third chamber 21*c*, a projecting hole 24 at one end of the first chamber 21*a*, a screw hole 25 at one end of the second chamber 21*b*, a rear opening 26 at an opposite end of the second chamber 21*b*, an end hole 27 at an opposite end of the first chamber 21*a* into which the rotary cap 6 fits, two opposite grooves 271 inside the end hole 27 through which two opposite lock keys 61 on the rotary cap 6 pass, and a clip slot 21*g* on the upper shell 21 adjacent to the end hole 27 on which a hook 281 of a clip 28** hooks.

The toggle switch 3 is consisted of a button 31, a PC board 32, and an elongated spring strip 33. The button 31 has an extension strip 311 at one end, and a press rod 313 within a bottom hole 312 thereof. The PC board 32 is covered with a first copper loop 321 and a second copper loops 322, and has a leaf spring 323 connected to the first copper loop 321. The leaf spring 323 has a opposite end connected to the laser module 1 by a cable. The elongated spring strip 33 has two opposite ends respectively terminated into a first hook 331 and a second hook 332 controlled by the button 31 to close the circuit for permitting the battery set 5 to be electrically connected to the laser module 1.

The push button ballpoint pen 4 is consisted of a front socket 41, a spring 42, a reservoir tube 43, a thrust axle 44, a sleeve 45, and a push button 46. The front socket 41 has a central through hole 411 through its longitudinal axis, through which the point of the reservoir tube 43 passes, and an externally threaded stub tube 412 at one end threaded into the screw hole 25 on the housing 2. The reservoir tube 43 is an ordinary product that can be easily obtained from the market. The thrust axle 44 has a rotary pawl 441 at one end, which catches the top end of the reservoir tube 43, and a screw rod 442 at an opposite end inserted through the bore 451 of the sleeve 45 and threaded into a screw hole 463 on the bottom of the push button 46. The sleeve 45 has two longitudinal rails 45 symmetrically disposed on the inside to guide the thrust axle 44 for permitting it to be moved in longitudinal direction. The push button 46 has a H-shaped flange 461 for positioning, and a flat top end 462 for pressing with the thumb.

The battery set 5 is consisted of two 1.5 V battery cells.

The rotary cap 6 has two opposite lock keys 61, which pass through the grooves 271 and are locked inside the end hole 27 through a rotary motion, and a contact spring 63 fastened inside a bottom hole 62 thereof. The contact spring 63 has a circular flange 631 at one end. Once the rotary cap 6 has been locked in place, the circular flange 631 is disposed in contact with the second hook 332 of the elongated spring strip Referring to FIGS. 2 and 4 again, the push button ballpoint pen 4 is fastened inside the second chamber 21*b*, the extension strip 311 of the button 31 and the PC board 32 and spring strip 33 of the toggle switch 3 are placed in the third chamber 21*c* and respectively fastened in the retaining grooves 21*d* and retaining notches 21*e*, then the upper shell 21 is fastened to the bottom shell 22 and the battery set 5 is inserted through the end hole 27 into the first chamber 21*a*, and then the rotary cap 6 is fastened in the end hole 27 with the contact spring 63 stopped against the positive terminal of the battery set 5 and the circular flange 631 of the contact spring 63 disposed in contact with the second hook 332 of the elongated spring strip 33.

Figure 5B:
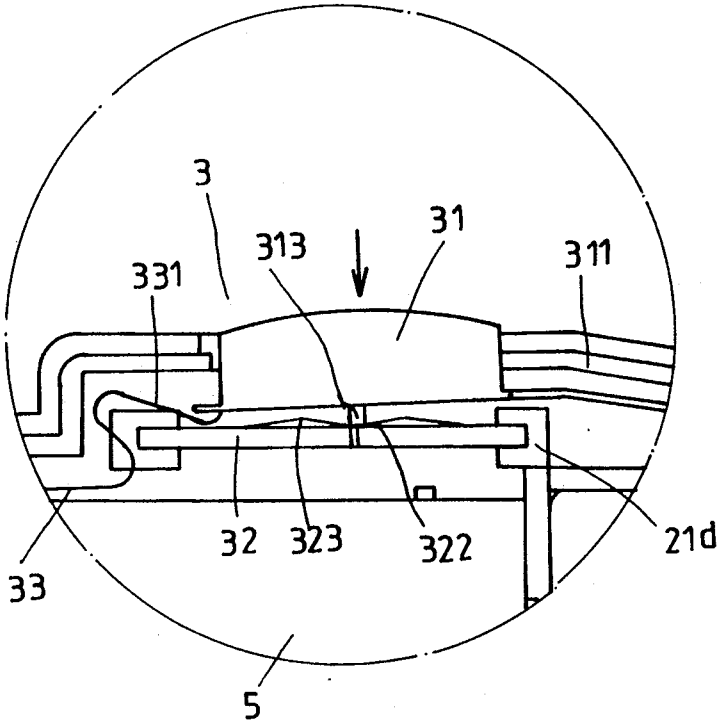
FIG. 5B illustrates the toggle switch pressed down to connect the circuit.
Figure 5A:
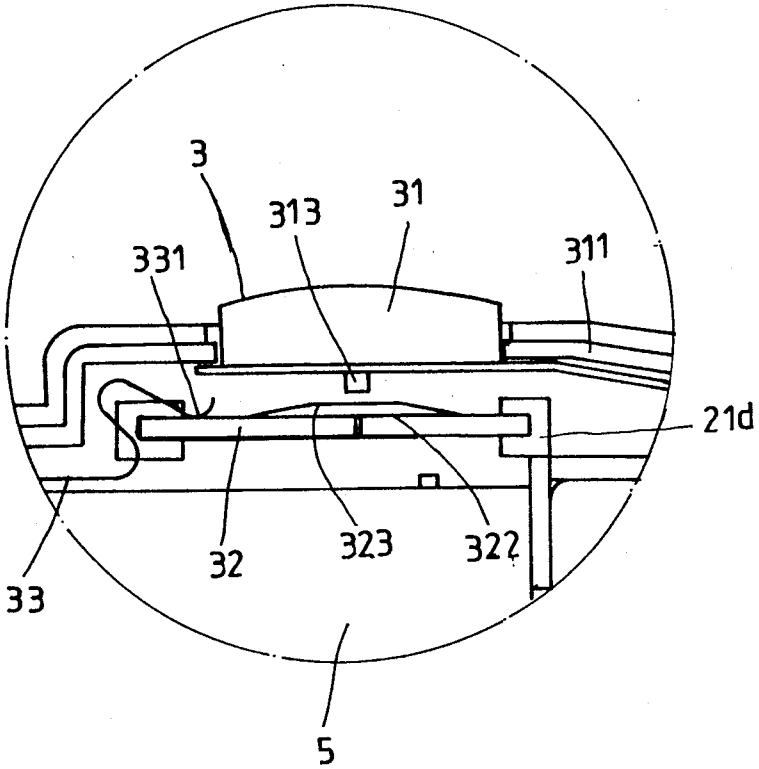
FIG. 5A illustrates the toggle switch released to cut off the circuit.

Referring to FIGS. 5A and 5B, pressing the button 31 causes press rod 313 pressed against the leaf spring 323 of the PC board 32 in connecting the second copper loop 322, and therefore the trigger circuit board 131 of the laser module 1 is electrically connected to trigger the laser diode 12 in causing it to emit a laser beam for pointing.

Figure 6:
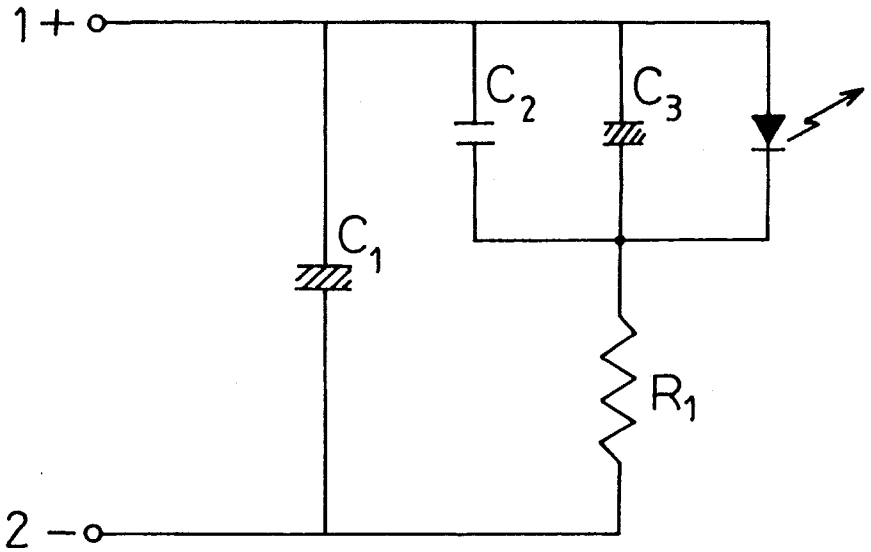
FIG. 6 is a circuit diagram according to the present invention.

Referring to FIG. 6, 3 V DC power supply is sent through contact 1 and contact 2 and filtrated through C1, then limited and divided by R1, and then sent to the laser diode. C2 and C3 are protective capacitors which protect the laser diode against surge voltage.

Figure 7:
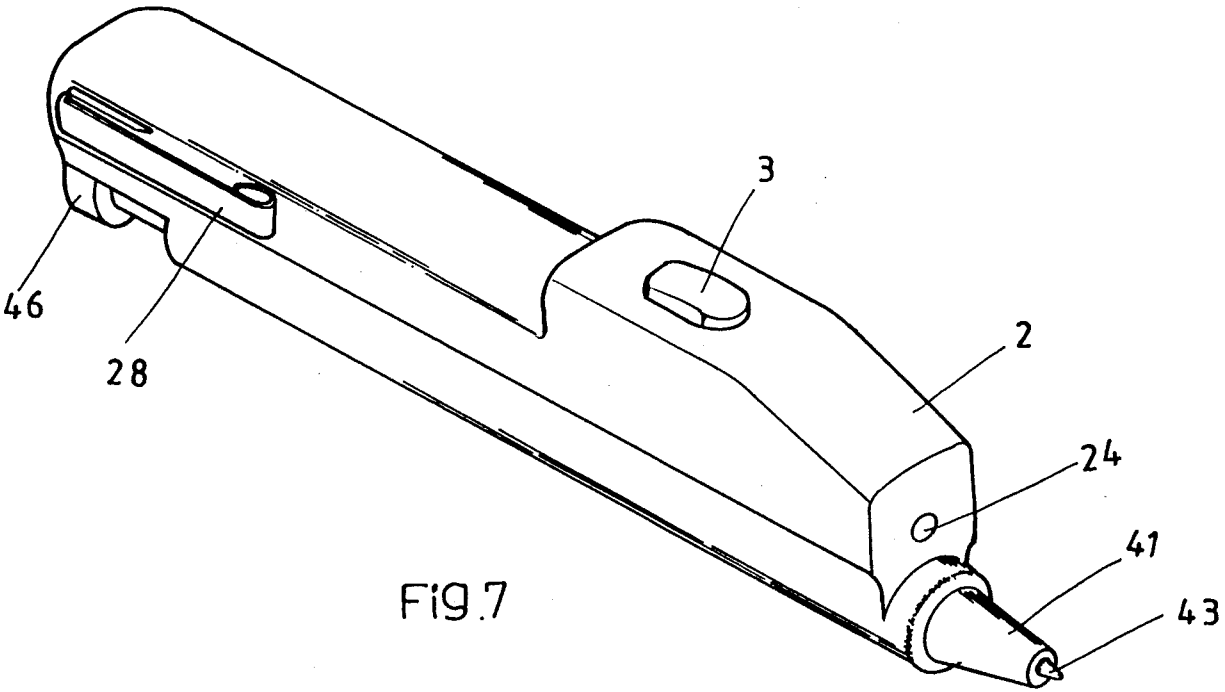
FIG. 7 illustrates the push button ballpoint ballpoint pen pressed into operative position.
Figure 8:
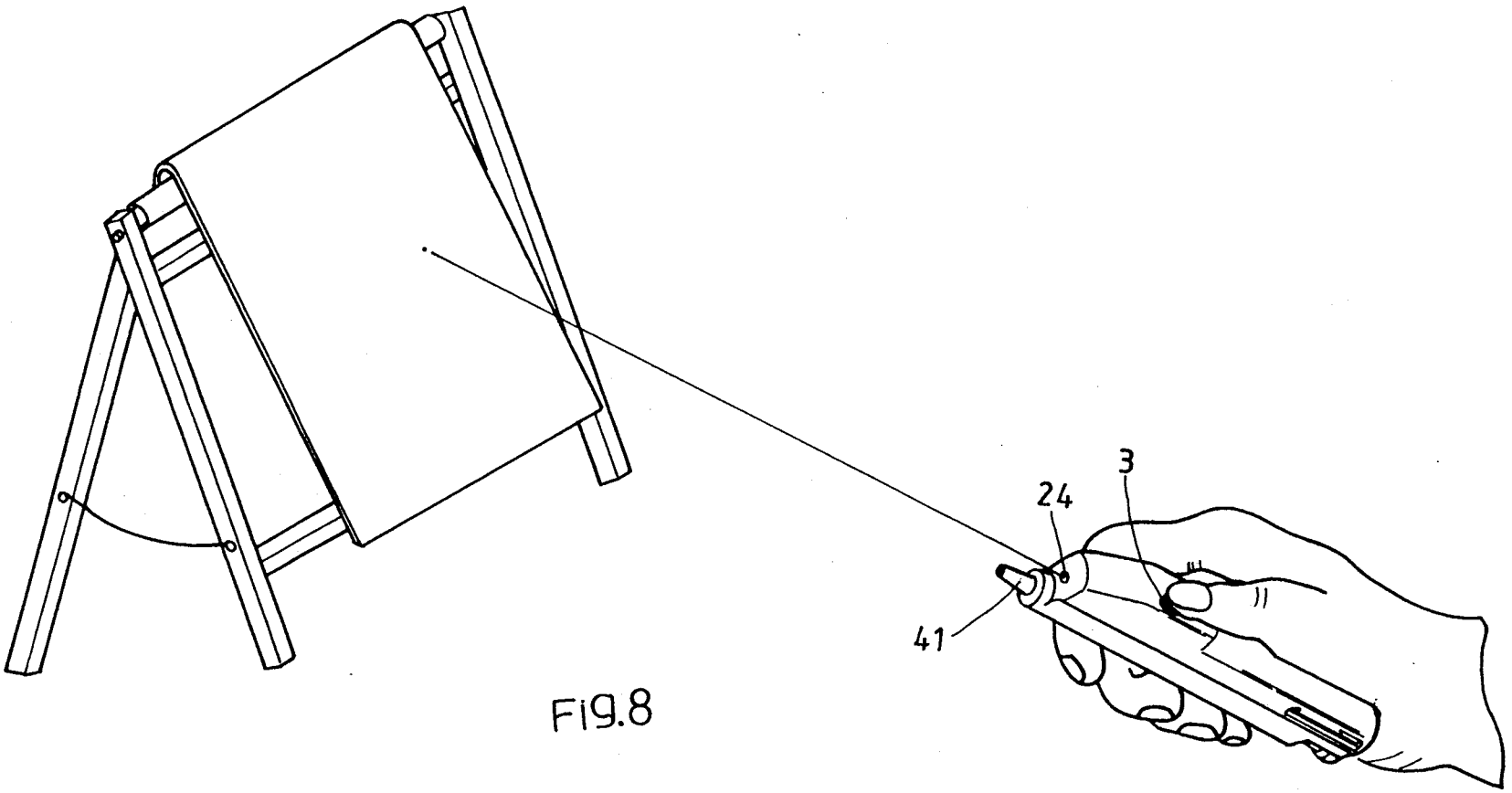
FIG. 8 illustrates the laser pointer triggered to emit a laser beam for pointing.

Referring to FIGS. 7 and 8, the push button ballpoint pen 4 is used for writing; the toggle switch 3 is switched to drive the laser module emitting a laser beam for pointing to things on a map, etc.

I claim:

1. A laser pointer comprised of a laser module, a housing, a toggle switch, a push button ballpoint pen, a battery set, and a rotary cap, wherein:

said laser module is comprised of a lens assembly, a laser diode, and a laser mechanism, said lens assembly having a plastic lens fastened in a bore by an O-ring behind a front projecting hole, said laser mechanism having a front tube fitted into said bore and stopped at said plastic lens against said O-ring, a laser diode and a trigger circuit board, said laser diode being connected to said trigger circuit board by welding, said trigger circuit board being connected to said toggle switch;

said housing consist of an upper shell and a bottom shell respectively made of a plastic material through the process of injection molding, said upper shell having a peripheral flange inserted in a peripheral groove on said bottom shell and a peripheral welding strip welded to a peripheral welding strip on said bottom shell, said housing comprising a first chamber, which receives said laser module and said battery set, a second chamber, which receives said push button ballpoint pen, a third chamber, which receives said toggle switch, a toggle switch slot in communication with said third chamber, a projecting hole at one end of said first chamber, a screw hole at one end of said second chamber, a rear opening at an opposite end of said second chamber, an end hole at an opposite end of said first chamber into which said rotary cap fits, two opposite grooves inside the end hole through which two opposite lock keys on said rotary cap pass, and a clip slot on said upper shell adjacent to said end hole to hold a clip;

said toggle switch consist of a button, a printed circuit board, and an elongated spring strip, said button having an extension strip at one end for automatic return control, and a press rod within a bottom hole thereof, said printed circuit board having one end connected to said laser module by a leaf spring and a cable and an opposite end connected to said battery set by said elongated spring strip through said rotary cap;

said push button ballpoint pen is consisted of a front socket, a spring, a reservoir tube, a thrust axle, a sleeve, and a push button, said front socket having a central through hole through its length and an externally threaded stub tube at one end threaded into the screw hole on said housing, said thrust axle having a rotary pawl at one end, which catches said reservoir tube, and a screw rod at an opposite end inserted through said sleeve and threaded into a screw hole on a bottom of said push button, said sleeve having two longitudinal rails on the inside for guiding said thrust axle in moving in longitudinal direction, said push button having a H-shaped flange for positioning, a screw hole into which the screw rod of said thrust axle is threaded, and a flat top end for pressing with the thumb; and said rotary cap has two opposite lock keys, which pass through the grooves inside said end hole and then are locked inside said end hole through a rotary motion, a contact spring fastened inside a bottom hole thereof, said contact spring being connected to said battery set and having a circular flange disposed in contact with said elongated spring strip of said toggle switch.

2. The laser pointer of claim 1 wherein said clip can be directly molded on said housing.

3. The laser pointer of claim 1 wherein the button of said toggle switch is made of silicon rubber.

* * * * *